US005602626A

United States Patent [19]

Facci et al.

[11] Patent Number: 5,602,626

[45] Date of Patent: Feb. 11, 1997

[54] IONICALLY CONDUCTIVE LIQUID CHARGING APPARATUS

[75] Inventors: John S. Facci; Michael J. Levy, both of Webster; Joseph Mammino, Penfield; Richard B. Lewis, Williamson; Martin A. Abkowitz, Webster; James M. Markovics, Rochester, all of N.Y.

[73] Assignee: Xerox Corporation, Stamford, Conn.

[21] Appl. No.: 497,987

[22] Filed: Jul. 3, 1995

[51] Int. Cl.[6] ..... G03G 15/02

[52] U.S. Cl. ..... 399/135; 361/225

[58] Field of Search ..... 355/219; 361/225

[56] References Cited

U.S. PATENT DOCUMENTS

| | | | |
|---|---|---|---|
| 2,904,431 | 9/1959 | Moncrieff-Yeates | 96/1 |
| 2,987,660 | 6/1961 | Walkup | 317/362 |
| 3,394,002 | 7/1968 | Bickmore | 96/1 |
| 5,457,523 | 10/1995 | Facci et al. | 355/219 |

FOREIGN PATENT DOCUMENTS

| | | |
|---|---|---|
| 59-61858 | 4/1984 | Japan . |
| 04109262 | 4/1992 | Japan . |
| 05297683 | 11/1993 | Japan . |

OTHER PUBLICATIONS

English Abstract of Japanese Kokai JP 06110257, Patent Pub. Date Apr. 22, 1994.

*Primary Examiner*—R. L. Moses
*Attorney, Agent, or Firm*—Denis A. Robitaille

[57] ABSTRACT

An apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a conductive housing, wherein the housing is coupled to an electrical power supply for applying an electrical potential to the ionically conductive liquid. In one specific embodiment, the charging apparatus includes a support blade for urging the donor blade into contact with the charge retentive surface and a wiping blade for wiping any liquid from the surface of the charge retentive surface as may have been transferred to the surface at the donor blade/charge retentive surface interface.

44 Claims, 2 Drawing Sheets

IONICALLY CONDUCTIVE LIQUID CHARGING APPARATUS

Figure 1:
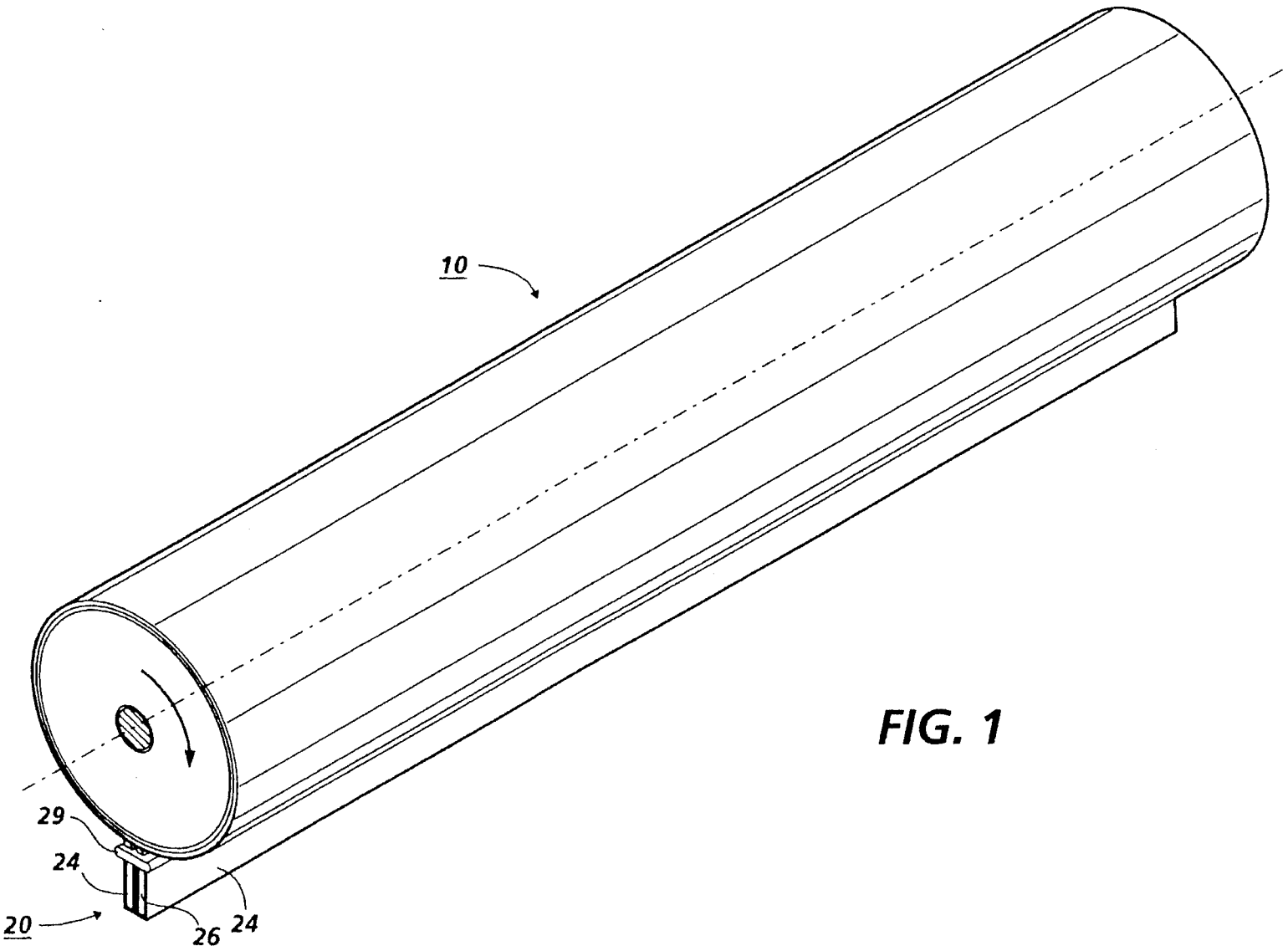

The present invention relates generally to an apparatus for depositing a substantially uniform charge on an adjacent surface, and, more particularly, concerns an apparatus for enabling ion transfer via ionic conduction through an ionically conductive liquid, primarily for use in electrostatographic applications, for example, for charging an imaging member such as a photoreceptor or a dielectric charge receptor.

Generally, the process of electrostatographic reproduction is initiated by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original document on the photoreceptive member. This latent image is subsequently developed into a visible image by a process in which a charged developing material is deposited onto the photoconductive surface such that the developing material is attracted to the charged image areas on the photoreceptor. Thereafter, the developing material is transferred from the photoreceptive member to a copy sheet or some other image support substrate to which the image may be permanently affixed for producing a reproduction of the original document. In a final step in the process, the photoconductive surface of the photoreceptive member is cleaned to remove any residual developing material therefrom in preparation for successive imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the dis-charged area, known as DAD, or "write black" systems, in contradistinction to the light lens generated image systems which develop toner on the charged areas, known as CAD, or "write white" systems. the subject invention applies to both such systems.

Various devices and apparatus have been proposed for applying in uniform an electrostatic charge or charge potential to a photoconductive surface prior to the formation of the latent image thereon. Typically, a corona generating device is utilized for applying charge to the photoreceptor, wherein a suspended electrode comprising one or more fine conductive elements is biased at a high voltage potential, causing ionization of surrounding air which results in deposition of an electric charge on an adjacent surface, namely the photoreceptor. Corona generating devices are well known, as described, for example, in U.S. Pat. No. 2,836,725, to R. G. Vyverberg, wherein a conductive corona generating electrode or so-called coronode in the form of an elongated wire is partially surrounded by a conductive shield. The coronode is provided with a DC voltage, while the conductive shield is usually electrically grounded and the dielectric surface to be charged is mounted on a grounded substrate, spaced from the coronode opposite the shield. Alternatively, the corona device may be biased in a manner taught in U.S. Pat. No. 2,879,395, wherein the flow of ions from the electrode to the surface to be charged is regulated by an AC corona generating potential applied to the conductive wire electrode and a DC potential applied to a conductive shield partially surrounding the electrode. This DC potential allows the charge rate to be adjusted, making this biasing system ideal for self regulating systems. Other biasing arrangements are known in the prior art and will not be discussed in great detail herein.

In addition to charging the imaging surface of an electrostatographic system prior to exposure, corona generating devices of the type described, or so-called corotrons, can be used in the transfer of an electrostatic toner image from a photoreceptor to a transfer substrate, in tacking and detacking paper to or from the imaging member by neutralizing charge on the paper, and, generally, in conditioning the imaging surface prior to, during, and after the deposition of toner thereon to improve the quality of the xerographic output copy produced thereby. Each of these functions can be accomplished by a separate and independent corona generating device. The relatively large number of devices within a single machine necessitates the economical use of corona generating devices.

Several problems have historically been associated with corona generating devices. The most notable problem centers around the inability of such corona devices to provide a uniform charge density along the entire length of the corona generating electrode, resulting in a corresponding variation in the magnitude of charge deposited on associated portions of the adjacent surface being charged. Other problems include the use of very high voltages (6000–8000 V) requiring the use of special insulation, inordinate maintenance of corotron wires, low charging efficiency, the need for erase lamps and lamp shields and the like, arcing caused by non-uniformities between the coronode and the surface being charged, vibration and sagging of corona generating wires, contamination of corona wires, and, in general, inconsistent charging performance due to the effects of humidity and airborne chemical contaminants on the corona generating device. More importantly, corotron devices generate ozone, resulting in well-documented health and environmental hazards. Corona charging devices also generate oxides of nitrogen which eventually desorb from the corotron and oxidize various machine components, resulting in an adverse effect on the quality of the final output print produced thereby.

Various approaches and solutions to the problems inherent to the use of suspended wire corona generating charge devices have been proposed. For example, U.S. Pat. No. 4,057,723 to Sarid et al. shows a dielectric coated coronode uniformly supported along its length on a conductive shield or on an insulating substrate. That patent shows a corona discharge electrode including a conductive wire coated with a relatively thick dielectric material, preferably glass or an inorganic dielectric, in contact with or spaced closely to a conductive shield electrode. U.S. Pat. No. 4,353,970 discloses a bare wire coronode attached directly to the outside of a glass coated secondary electrode. U.S. Pat. No. 4,562,447 discloses an ion modulating electrode that has a plurality of apertures capable of enhancing or blocking the passage of ion flow through the apertures. In addition, alternatives to corona generating charging systems have been developed. For example, roller charging systems, as exemplified by U.S. Pat. Nos. 2,912,586 to Gundlach; 3,043,684 to Mayer; 3,398,336 to Martel et al., have been disclosed and discussed in numerous articles of technical literature.

The present invention relates to a device for charging photoconductive imaging members via ionic conduction through a fluid or liquid media such as water, wherein corona generating devices and other known devices for inducing a charge on an adjacent surface, together with their known disadvantages, can be avoided. The following disclosures may be relevant to various aspects of the present invention:

U.S. Pat. No. 2,904,431
Patentee: Moncrieff-Yeates
Issued: Sep. 15, 1959

U.S. Pat. No. 2,987,660
Patentee: Walkup
Issued: Jun. 6, 1961

U.S. Pat. No. 3,394,002
Patentee: Bickmore
Issued: Jul. 23, 1968
Japanese Patent Application Document No.: 59-61858
Inventor: Itaya
Publication Date: Apr. 9, 1984

Japanese Patent Application Document No.: 04-109262
Inventor: Haneda
Publication Date: Apr. 10, 1992

Japanese Patent Application Document No.: 05-297683
Inventor: Miyaki
Publication Date: Nov. 12, 1993

U.S. patent application Ser. No.: 08/250,191
Inventor: Facci et al.
Filing Date: May 27, 1994

The relevant portions of the foregoing disclosures may be briefly summarized as follows:

U.S. Pat. No. 2,904,431 discloses a method and apparatus for providing electrical connection to a body of semi-conductive or dielectric material, wherein the method comprises closely spacing the surface of an electrode from the surface of the body to which connection is to be made with a film forming liquid. When a voltage is applied to the electrode, an electric field is generated across the liquid film, causing the liquid to behave as a conductor transversely through the layer while continuing to behave as an insulator in the lateral direction. That patent includes a method of electrically charging the surface of a body of semi-conductive or dielectric material.

U.S. Pat. No. 2,987,660 discloses a xerographic charging process for applying an electric charge to the surface of an insulating or photoconductive insulating layer by electrification with a conductive or electrolytic liquid wherein the charge applied is of substantially the same potential as the potential on the contacting liquid and is substantially uniform across the entire area being charged.

U.S. Pat. No. 3,394,002 discloses a method of applying charge onto an electrically insulating surface utilizing a liquid of high resistivity across which an electrostatic image is transferred. More particularly, that patent relates to the chemical doping of liquid materials utilized in various electrostatic imaging systems whereby the electrical charge transfer characteristics thereof are controlled for effecting image charge transfer between juxtaposed surfaces of different imaging materials.

Japanese Patent Application Document No. 59-61858 discloses a charging/discharging device comprising ferromagnetic metal fluid retained in a magnetic field formed by a magnetic field generation means. The features of the structure described in that publication are attained by bringing ferromagnetic metal fluid into direct contact with the surface of an insulator to be charged or discharged, whereby the ferromagnetic fluid is maintained at an electrode section through magnetism for contacting the insulator to be charged or discharged. Magnetic bodies are mounted on both sides of a rotatable magnet, whereby the magnet is rotated for selectively contacting the fluid media with the member to be charged.

Japanese Patent Application Document No. 04-109262 discloses a charging device which restrains magnetic fluid via magnetic force, wherein a magnetic fluid is interposed between a pair of conducting magnets. The structure disclosed in that publication is described as having a magnet positioned on the left and right with a retaining unit positioned at the rear to form a support frame for magnetic fluid, whereby the magnetic fluid is supported and restrained by the magnetism of the magnets positioned on the left and right.

Japanese Patent Application Document No. 05-297683 discloses a charging device comprising a liquid high resistance charging electrode, whereby a receptacle is filled with a liquid charging electrode and a high voltage power source is connected to the liquid electrode in order to complete a structure in which corona discharge develops between the liquid charging electrode and a photoreceptive drum.

U.S. patent application Ser. No. 08/250,090 discloses a device for applying an electrical charge to a charge retentive surface by transporting ions in a fluid media and transferring the ions to the member to be charged. The fluid media is a ferrofluid material wherein a magnet is utilized to control the position of the fluid media, which in turn can be utilized to selectively control the activation of the charging process.

In accordance with the present invention, an apparatus for applying an electrical charge to a member is provided, comprising a donor member positioned in contact with the member to be charged and wetted with an ionically conductive liquid; and means for applying an electrical bias to the wetted donor member, wherein the electrical bias transports ions through the ionically conductive liquid to the member to be charged for transferring ions thereto.

In accordance with another aspect of the invention, an electrostatographic printing machine including a charging device for applying an electrical charge to an imaging member is provided, comprising: a donor member positioned in contact with the imaging member and wetted with an ionically conductive liquid; and means for applying an electrical bias to the wetted donor member, wherein the electrical bias transports ions through the ionically conductive liquid to the imaging member for transferring ions thereto.

Figure 2:
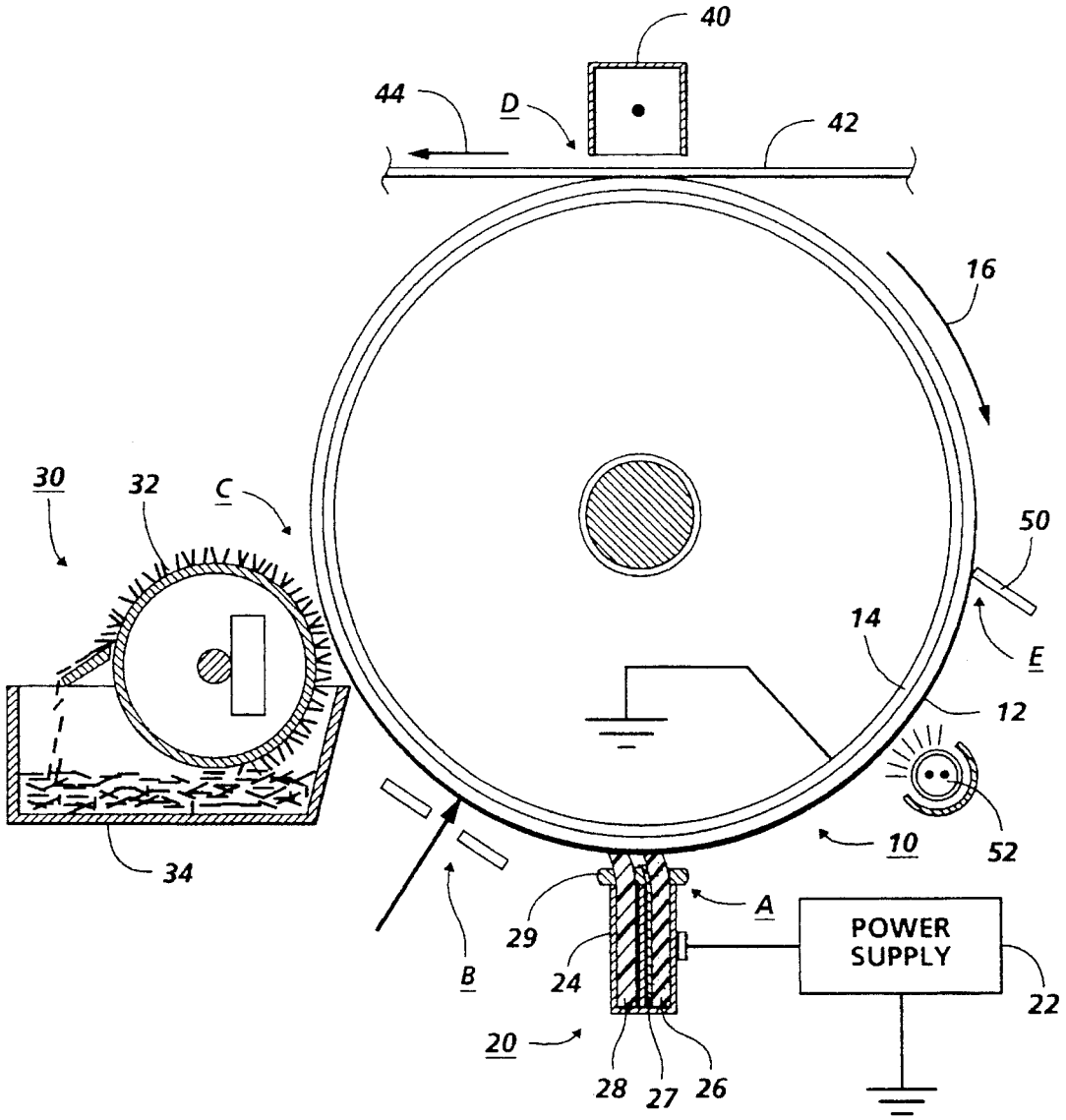

These and other aspects of the present invention will become apparent from the following description in conjunction with the accompanying drawings in which:

FIG. 1 is a simple perspective view of the ionically conductive liquid charging apparatus of the present invention; and FIG. 2 is a schematic elevational view showing an electrostatographic copier employing the ionically conductive liquid charging apparatus of the present invention.

For a general understanding of the features of the present invention, reference is made to the drawings wherein like reference numerals have been used throughout to designate identical elements. While the present invention will be described in connection with a preferred embodiment thereof, it will be understood that the invention is not limited to this preferred embodiment. On the contrary, the present invention is intended to cover all alternatives, modifications, and equivalents as may be included within the spirit and scope of the invention as defined by the appended claims.

Referring initially to FIG. 2 prior to describing the invention in detail, a schematic depiction of the various components of an exemplary electrostatographic reproducing apparatus incorporating the ionically conductive liquid charging apparatus of the present invention is provided. It will be understood that, although the apparatus of the present invention is particularly well adapted for use in an automatic electrostatographic reproducing machine, the instant charging structure is equally well suited for use in a wide variety of electrostatographic-type processing machines and is not necessarily limited in its application to the particular embodiment or embodiments shown herein. In particular, it should be noted that the charging apparatus of the present invention, described hereinafter with reference to an exemplary charging system, may also be used in a transfer, detack, or cleaning subsystem of a typical electrostatographic apparatus since such subsystems also require the use of a charging device.

The exemplary electrostatographic reproducing apparatus of FIG. 2 employs a drum 10 including a photoconductive surface 12 deposited on an electrically grounded conductive substrate 14. A motor (not shown) engages with drum 10 for rotating the drum 10 in the direction of arrow 16 to advance successive portions of photoconductive surface 12 through various processing stations disposed about the path of movement thereof, as will be described.

Initially, a portion of drum 10 passes through charging station A. At charging station A, a charging device in accordance with the present invention, indicated generally by reference numeral 20, charges the photoconductive surface 12 on drum 10 to a relatively high, substantially uniform potential. This charging device in accordance with the present invention will be described in detail following the instant discussion of the electrostatographic apparatus and process.

Once charged, the photoconductive surface 12 is advanced to imaging station B where an original document (not shown) may be exposed to a light source (also not shown) for forming a light image of the original document onto the charged portion of photoconductive surface 12 to selectively dissipate the charge thereon, thereby recording onto drum 10 an electrostatic latent image corresponding to the original document. One skilled in the art will appreciate that various methods may be utilized to irradiate the charged portion of the photoconductive surface 12 for recording the latent image thereon as, for example, a properly modulated scanning beam of energy (e.g., a laser beam).

After the electrostatic latent image is recorded on photoconductive surface 12, drum 10 is advanced to development station C where a development system, such as a so-called magnetic brush developer, indicated generally by the reference numeral 30, deposits developing material onto the electrostatic latent image. The exemplary magnetic brush development system 30 shown in FIG. 2 includes a single developer roller 32 disposed in developer housing 34, in which toner particles are mixed with carrier beads to create an electrostatic charge therebetween, causing the toner particles to cling to the carrier beads and form developing material. The developer roller 32 rotates to form a magnetic brush having carrier beads and toner particles magnetically attached thereto. As the magnetic brush rotates, developing material is brought into contact with the photoconductive surface 12 such that the latent image thereon attracts the toner particles of the developing material, forming a developed toner image on photoconductive surface 12. It will be understood by those of skill in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image in a timed sequence so that the developed image on the photoconductive surface 12 contacts the advancing sheet of support material 42 at transfer station D. A charging device 40 is provided for creating an electrostatic charge on the backside of sheet 42 to aid in inducing the transfer of toner from the developed image on photoconductive surface 12 to the support substrate 42. While a conventional coronode device is shown as charge generating device 40, it will be understood that the ionically conductive liquid charging device of the present invention might be substituted for the corona generating device 40 for providing the electrostatic charge which induces toner transfer to the support substrate materials 42. After image transfer to the substrate 42, the support material 42 is subsequently transported in the direction of arrow 44 for placement onto a conveyor (not shown) which advances the sheet to a fusing station (also not shown) which permanently affix the transferred image to the support material 42 thereby for a copy or print for subsequent removal of the finished copy by an operator.

Often, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10. Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp (not shown) for flooding the photoconductive surface 12 with light in order to dissipate any residual electrostatic charge remaining thereon in preparation for a subsequent imaging cycle. As will be understood, the present invention may also be utilized as a substitute for such a discharge lamp by providing a neutralizing charge for countering any residual electrostatic charge on the photoconductive surface 12.

The foregoing description should be sufficient for purposes of the present application for patent to illustrate the general operation of an electrostatographic reproducing apparatus incorporating the features of the present invention. As described, an electrostatographic reproducing apparatus may take the form of any of several well known devices or systems. Variations of the specific electrostatographic processing subsystems or processes described herein may be expected without affecting the operation of the present invention. For example, to those skilled in the art, the photoconductive coating of the photoreceptor may be placed on a flexible belt of either seamed or unseamed construction, continuous or not, without affecting the operation of the present invention.

Referring now, more particularly, to the specific subject matter of the present invention, an exemplary ionically conductive liquid charging apparatus 20 in accordance with the present invention will be described in greater detail with reference to FIGS. 1 and 2. The specific embodiment of the present invention is directed to a device for charging a photoreceptor 10 by the transfer of ions thereto. In general, the present invention comprises an apparatus which is suitable for contacting a liquid material like distilled water or deionized water, or some other liquid material which may include a gelling agent, as will be discussed, with the surface 12 of the photoreceptor 10. A voltage being applied to the liquid material while the photoreceptor 10 is rotated or transported relative to the liquid material, thereby enabling the transfer of ions, preferably of a single sign, such as positive or negative polarity, from the liquid photoreceptor interface to the photoreceptor surface 12. The photoreceptor surface 12 thus becomes charged by the voltage applied to the liquid component in contrast to applying a voltage directly to the photoreceptor via a corotron or other corona generating device.

The ionically conductive liquid charging apparatus of the present invention is comprised of a conductive housing 24 for supporting a wetted liquid donor blade 26 in contact with the surface 12 of photoreceptor 10. Housing 24 is fabricated of brass, stainless steel or any other conductive material or conductive composite such as a carbon loaded polymer. Preferably, the housing 24 is fabricated from a material which allows conduction of electricity while not being susceptible to oxidation or corrosion upon exposure to the particular ionically conductive liquid utilized by the invention, as will be discussed. The housing 24 may also serve as a reservoir for storing an amount of the ionically conductive liquid used to wet the liquid donor blade 26 supported therein.

The conductive housing 24 is coupled to a DC voltage power supply 22 for applying an ion transporting bias voltage to the wetted donor blade 26, whereby a voltage bias is applied to the liquid donor blade 26 and the ionically conductive liquid material wetted thereby via DC power supply 22 coupled to housing 24. Alternatively, electrical contact can also be made to the ionically conductive fluid either by immersing a wire into the fluid, if the fluid container is comprised of an electrically insulating material, rather than applying a voltage directly to the fluid container, when it is comprised of a conductive material. Typical voltages provided by the power supply 22 might range from about −4000 V to about +4000 V, and preferably between about ±400 to about ±700. The voltage that is applied to the photoreceptor surface 12 is essentially equal to the voltage applied to the ionically conductive liquid such that a voltage of 750 volts, for example, applied to the ionically conductive medium results in a voltage of about 750 volts or slightly less on the photoreceptor. The voltage supplied by the power source 22 can be of a positive or negative polarity, wherein the polarity of the charge deposited by the donor blade is exclusively controlled by the polarity of the supplied voltage. That is to say that the application of a positive bias to the ionically conductive liquid material causes positive ions to transfer to the photoreceptive member while the application of a negative bias to the ionically conductive liquid causes negative ions to transfer to the photoreceptive member.

Examples of ionically conductive liquid materials which may serve satisfactorily in the context of the present invention include any liquid based material capable of conducting ions, including simple tap water and even distilled or deionized water (where the conductivity thereof is believed to be caused by the known dissolution of carbon dioxide in water). Components which can be added to the water to render it more ionically conductive include atmospheric carbon dioxide ($CO_2$), lithium carbonate, sodium carbonate, potassium carbonate, sodium bicarbonate and the like. The concentration ranges can vary from trace levels to saturation. Another example of an ionically conductive medium is a gel that is composed of 96 wt % water and 4 wt % acrylic acid neutralized with NaOH. Other hydrogels include polyhydroxyethylmethacrylates, polyacrylates, polyvinylpyrrolidinone and the like. Other gel materials include gelatin, gums and mucilages both natural and synthetic. Numerous other fluid compounds and materials which may be desirable for use with the apparatus of the present invention are described in commonly assigned patent application entitled Photoconductive Charging Processes filed on May 27, 1994, identified by Ser. No. 08/250,749.

Donor blade 26 is a relatively flexible blade member which may be fabricated from a porous or microporous elastomeric polymer like polyurethane or polyvinylalcohol-co-polyvinylformal (polyvinylalcohol crosslinked with formaldehyde) which provides for bringing the pure liquid or ionically conductive liquid in contact with the photoreceptor surface 12. This blade member should be wettable, preferably hydrophilic especially when the liquid is water, by the particular ionically conductive liquid being utilized. For example, polyurethane foam, compressed polyurethane foam, or polyvinylalcohol-co-polyvinylformal foam can be used to provide a compliant blade member. Alternatively, the donor blade 26 can be fabricated from a hydrophobic polymer, for example VITON®, a copolymer of vinylidene fluoride/hexafluoropropylene, or terpolymers of vinylidene fluoride/hexafluoropropylene and tetrafluoroethylene. The surface of the blade can be chemically treated so as to make it hydrophilic. For example, it may be treated by exposure to ozone gas, or other oxidizing agents such as chromic acid. Yet another way of making a surface, such as VITON®, hydrophilic is to roughen it, for example by sanding it with fine sand paper. Other hydrophobic polymers for the donor blade include polyethylene, polypropylene, polyethylpentane, polybutadiene and silicone elastomers.

The surface of the blade member 26 may alternatively be rendered hydrophilic by filling the elastomer with finely divided conductive particles, such as aluminum, zinc or oxidized carbon black, aluminum oxide, tin oxide, titanium dioxide, zinc oxide and the like, to the extent of 0.1 to 10 percent. Both the conductive and semiconductive particles can be embedded in the surface layer of the elastomer by heating the elastomer above its glass transition temperature or by depositing a layer of adhesive onto the elastomer and spraying the particles onto the surface. The thickness of this layer can be from 0.1 micron to 100 microns, and preferably is from about 10 to about 50 microns with a hardness of from about 10 A to about 60 A on the Shore A durometer Scale.

As can be seen from FIGS. 1 and 2, it is contemplated that the preferred embodiment of the present invention include a support member 27, fixed within the housing 24 and situated in abutment with donor blade 26, downstream from the donor blade 26 relative to the direction of travel 16 of the photoreceptor surface 12. The support member 27 is fabricated from a relatively rigid material with respect to the donor blade 26, providing structural integrity for urging the donor blade 26 against the photoreceptor surface 12 in a springloaded manner. It has been found that a thin strip of MYLAR® provides an effective support member 27, although those of skill in the art will understand that various other materials and structures may be utilized to accomplish the same results.

In addition to the support blade 27, the preferred embodiment shown in FIGS. 1 and 2 also include a wiper blade 28. The wiper blade 28 is provided for removing any small amount of fluid from the surface of the photoreceptor 12, as may have been transferred thereto at the interface between the wetted donor blade 26 and the photoreceptor surface 12. Thus, a polyurethane type blade situated downstream from the donor blade 26 and support blade 27 relative to the direction of travel 16 of the photoreceptor surface 12 is provided for eliminating transfer of water or other liquid to the photoreceptor surface. The use of a wiper blade also advantageously permits a higher concentration of liquid to be applied by the donor blade 26. Clearly, the effectiveness of the wiper blade 28 can be enhanced by optimizing such factors as the liquid concentration at the donor blade 26/photoreceptor surface 12 interface, the wipe angle of the wiper blade 28 as well as the stiffness of the wiper blade 28. The wiper blade 28 also provides increased operational lifetime to the charging system of the present invention by returning the ionically conductive liquid to the donor blade 26 or to a reservoir coupled to the donor blade 26 for use in successive charging operations. In this regard, the housing 24, shown in FIGS. 1 and 2, which illustrates a central support member situated between the donor blade 26 and the wiper blade 28, may include a plurality of openings for allowing liquid to pass from a channel supporting the wiper blade 28 to a channel supporting the donor blade 26/support blade 27 combination. Alternatively, or in addition, a liquid management system (not shown) may be provided for adding liquid to the housing 24 of the charging apparatus 20 for continually moistening the donor blade.

It is noted that the fluid in housing 24 may be prevented from leaking out of the housing 24 by a lubricated rubber gasket or shoe 29. The rubber is selected to conform to asperities in the photoreceptor surface 12 and to any curvature in the photoreceptor, such as a drum 10.

In operation, the device of the present invention enables ionic conduction charging of a photoconductive imaging member, or any dielectric member placed in contact therewith, by placing an ionically conductive liquid component in contact with the surface of the photoconductive imaging member and applying a voltage to the ionically conductive liquid component such that ions are transferred across the liquid photoreceptive member interface to the photoreceptor surface. The photoreceptor thus becomes charged by the flow of ions through the liquid component rather than by the spraying of ions onto the photoreceptor through a gaseous media as occurs in a corotron or like corona generating device. In simplest terms, the ionically conductive liquid is biased by a voltage approximately equal to the surface potential desired on the photoreceptor, causing ions to be deposited at the point of contact between the ionic liquid and the photoreceptor until the electric field across is completely diminished.

In embodiments, the photoreceptor is charged by wetting a foam component contained in a metal housing, such as brass vessel with wedging rods that attach the foam to the vessel. The photoreceptor is placed within close proximity of the brass vessel and the foam contacts the imaging member. The foam is also in contact with the brass vessel or container. A power source is connected to the vessel and a-voltage is applied to the foam via the vessel. This voltage causes the $HCO_3^-$ and $H_3O+$ ions present in distilled or deionized water in equilibrium with air in the water to separate. When a positive voltage is applied from the power source, positive ions migrate toward the imaging member, and when a negative voltage is applied from the power source negative ions migrate toward the imaging member. Rotation or translation of the imaging member causes charge to transfer from the foam to the imaging member, and which charge is substantially equivalent or equivalent to the voltage applied from the power source.

In a specific embodiment of the present invention which has been reduced to practice and tested, a customer replaceable cartridge from a Canon PC310 copier was removed and retrofitted with the FIG. 1 device. Two pieces of brass rectangular stock 8 and ⅞ inches long were soldered together. The top was milled off to allow for the placement of a foam into the resultant two channels. The foam was of open cell and high density structure and manufactured from polyvinylalcohol crosslinked with formaldehyde, commercially available from the Shima American Corporation, Elmhurst, Ill. Two rods approximately 8 inches long were wedged into the channels to hold the foam in place. The foam was moistened, but not saturated, with water. A wire was soldered to the brass case to provide the applied voltage. The device was retrofitted into the normal charging area of the cartridge. The device was denied the charging voltage, a combined AC plus DC signal that was normally supplied to the Canon bias charge roller charging device. Instead, a separate tunable DC only voltage was externally supplied using a commercially available DC/DC converter. A voltage of −650 volts was optimal for obtaining excellent prints. The prints showed a 7 line pair per millimeter resolution, excellent edge acuity, dense solid area coverage, good gray scale evenness. Other modifications of the present invention may occur to those skilled in the art subsequent to a review of the present application and these modifications, including equivalents thereof, are intended to be included within the scope of the present invention.

In review, the present invention is directed to an apparatus for charging photoreceptors by the transfer of ions thereto from an ionically conductive medium, and wherein this medium is comprised of a liquid material including deionized water or distilled water, or an ionically conductive liquid or gel and a process for the ion transfer charging of photoconductive imaging members, which comprises contacting an ionically conductive medium with the surface of the photoreceptor. A voltage is applied to the ionically conductive liquid medium while translating or rotating the photoreceptor past the ionically conductive medium, thereby enabling the transfer of ions to the photoreceptive member. A conductive housing is provided for contacting the liquid or an element such as a donor blade carrying the liquid to the photoreceptor surface. A support blade may be provided for urging the donor blade into contact with the photoreceptor. In addition, a wiper blade may be provided for removing any liquid droplets from the surface of the photoreceptor as may have been transferred thereto by the donor blade. Finally, a rubber gasket may also be provided for sealing the charging apparatus.

The process of the present invention is considered highly efficient when two conditions are met. The first is that of insignificant voltage drop in the ionically conductive medium or carrier (e.g. foam), which is satisfied in pure distilled water where the IR drop at 20 inches per second is no more than about 25 volts. This represents a waste of about 4 percent of the applied voltage when the applied voltage is 625 volts. The voltage drop across the ionically conductive medium can be reduced and the efficiency increased by increasing the ionic conductivity of the ionically conductive medium, which can be accomplished, for example, by adding a low concentration of an ionic species, for example, about 0.1 mM. The second condition is that the imaging member and the ionically conductive medium remain in contact for a sufficient period of time so that the voltage developed on the imaging member reaches the applied voltage less the IR drop in the ionically conductive medium. The Table that follows illustrates the calculated current expected at various process speeds. The assumptions are an applied voltage of 1,000 volts, a relative dielectric constant of 3.0, an imaging member thickness of 25 microns and a 16 inch long charging mechanism (1,000 $cm^2$/panel).

| PROCESS SPEED | CURRENT | POWER |
|---|---|---|
| 2 ips | 20 uA | 20 mW |
| 10 ips | 100 uA | 100 mW |
| 20 ips | 200 uA | 200 mW |

One advantage of ion transfer relative to a corotron is that ozone production is significantly reduced when charging layered imaging members. Contact ionic charging produces less than 1 percent of the ozone that a corotron produces. At voltages between 400 volts and +400 volts per mil, a corona is not visually observable in a completely darkened room with the process of the present invention. At ±800 volts per mil a very faint corona is observed. Also, the odor of ozone is not detectable even at ±1500 volts per mil with the process of the present invention. Measurements of ozone concentration at −550 were below the analytical detection limit of 0.005 parts per million. Since organic photoreceptors are usually charged to less than −800 volts, ion transfer charging of the present invention is for all practical purposes ozoneless. This eliminates one photoreceptor degradation mechanism, that is a print defect commonly known as parking deletions. In addition the need for ozone management and filtration is eliminated. Thus, ionic charging devices present a lower health hazard than a corotron or scorotron.

It is noted that the imaging member cannot be overcharged by the process disclosed in the present invention. The maximum voltage to which the imaging member can be charged is the voltage applied to the fluid media. The charging of the imaging member is limited to this value since the electric field across the bulk of the fluid medium, which drives the ions to the fluid/insulator interface, drops to zero when the voltage on the imaging member reaches the voltage applied to the fluid. Conversely, the imaging member can be undercharged if insufficient time is allowed for contact between the imaging member and the ionically conductive medium. The degree of undercharging is usually not significant (25–50 V) and can be compensated for by the application of a higher voltage to the ionically conductive medium. Moreover, it is noted that despite this voltage drop, the charge on the photoreceptor is uniform. The circumferential rotating speed of the photoreceptor can range from very low values like infinitesimally greater than zero speed to high speeds such as, for example, about 100 inches per second and preferably from zero to about 20 inches per second.

It is also noted that the device of the present invention can allow for the elimination of erase lamp 52 commonly utilized in a typical electrostatographic printing machine. Typically, an erase lamp is used to expose the photoreceptor after an imaging cycle for removing any residual charge thereon. The device of the present invention, however, could be used to accomplish the same result because the ionically conductive fluid medium is able to charge imaging members to any voltage including zero (0) volts, that is, to withdraw charge from the surface. Since the ionically conductive medium is able to charge imaging members to any voltage including zero (0) volts, it is possible to ground the ionically conductive liquid and withdraw the imagewise residual charge remaining on the imaging member back into the ionic medium, thereby erasing the charge. Indeed, it is possible to charge a surface with imagewise residual charge directly to the charged state without going through the intermediate erase step. This is not possible with any other practical charging system which can overcharge the surface. Therefore, an erase lamp is not needed to photodischarge the residual charge. Moreover, since the charge applied by the present invention is non-cumulative, the erase function typically associated with electrostatographic processes may be completely eliminated as a new charge can be applied independent of any pre-existing residual charge on the imaging member.

Another advantage of the processes of the present invention is that the complexity of the power supply can be diminished. Because it is not necessary to control the discharge of corona, only a DC voltage bias is applied to the fluid media. Thus, the power supply is simpler than typical charging systems which use an AC signal superimposed onto a DC signal. In addition, the voltages necessary to operate the present invention are lower than any other practical charging device.

Yet another advantage is the high degree of charge uniformity provide by the present invention. It is believed that the potential distribution on the dielectric being charged adjusts itself during the charging process in such a way that the undercharged areas tend to become "filled in" with the additional ions, leading to a uniform deposition of ions on the dielectric layer. It has been shown that the variation in surface voltage is essentially at or below the measurement accuracy of plus or minus 1 to 2 volts over a Mylar surface. The device has also been shown to be capable of uniformly charging a photoreceptor surface up to 50 inches per second.

It is, therefore, apparent that there has been provided, in accordance with the present invention, an ionically conductive liquid charging device that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

We claim:

1. An apparatus for applying an electrical charge to a member to be charged, comprising:

an ionically conductive liquid;

a donor member wetted with said ionically conductive liquid, said donor member being positioned in contact with the member to be charged;

a support blade situated in abutment with said donor member for urging said donor member against the member to be charged; and means for applying an electrical bias to said wetted donor member, wherein the electrical bias transports ions through said ionically conductive liquid to the member to be charged for transferring ions thereto.

2. The apparatus of claim 1, wherein said donor member is fabricated from a hydrophilic material selected from the group of polyurethane foam, and polyvinylalcohol-co-polyvinylformal foam.

3. The apparatus of claim 1, wherein said donor member is fabricated from a hydrophobic material selected from the group of VITON®, a copolymer of vinylidene fluoride/hexafluoropropylene, terpolymers of vinylidene fluoride/ hexafluoropropylene, tetrafluoroethylene, polyethylene, polypropylene, polyethylpentane, polybutadiene and silicone elastomers.

4. The apparatus of claim 1, wherein said ionically conductive liquid is selected from the group of distilled water, deionized water, and polyhydroxyethylmethacrylate, polyacrylates, polyvinylpyrrolidinone.

5. The apparatus of claim 4, wherein said ionically conductive liquid includes water having an ionically conductive component added thereto, said ionically conductive component being selected from the group of atmospheric carbon dioxide ($CO_2$), lithium carbonate, sodium carbonate, potassium carbonate, sodium bicarbonate, polyhydroxyethylmethacrylate, polyacrylates, polyvinylpyrrolidinone, sodium hydroxide, gelatin, gums and mucilages both natural and synthetic.

6. The apparatus of claim 1, further including a conductive housing for supporting said wetted donor member, said electrical bias applying means being coupled directly to said conductive housing for applying the electrical bias to said wetted donor member.

7. The apparatus of claim 6, wherein said housing is fabricated from a conductive material selected from the group of brass, stainless steel, and a polymer composite loaded with conductive particles.

8. The apparatus of claim 1, further including a wiper blade for removing any amount of ionically conductive liquid from the member to be charged.

9. An apparatus for applying an electrical charge to a member to be charged, comprising:

anionically conductive liquid;

a donor member wetted with said ionically conductive liquid, said donor member being positioned in contact with the member to be charged;

a wiper blade for removing any amount of ionically conductive liquid from the member to be charged; and means for applying an electrical bias to said wetted donor member, wherein the electrical bias transports ions through said ionically conductive liquid to the member to be charged for transferring ions thereto.

10. The apparatus of claim 6, further including a sealing member for preventing escape of said ionically conductive liquid from said housing at an interface with the member to be charged.

11. The apparatus of claim 1, wherein the member to be charged includes a photoconductive imaging member.

12. The apparatus of claim 1, wherein said means for applying an electrical bias to said ionically conductive liquid includes a DC voltage power supply.

13. The apparatus of claim 9, wherein said donor member is fabricated from a hydrophilic material selected from the group polyurethane foam, and polyvinylalchol-co-polyvinylformal foam.

14. The apparatus of claim 9, wherein said donor member is fabricated from a hydrophobic material selected from the group of VITON®, a copolymer of vinylidene fluoride/hexafluoropropylene, terpolymers of vinylidene fluoride/hexafluoropropylene, tetrafluoroethylene, polyethylene, polypropylene, polyethylpentane, polybutadiene and silicone elastomers.

15. The apparatus of claim 9, wherein said ionically conductive liquid is selected from the group of distilled water, deionized water, and polyhydroxyethylmethacrylate, polyacrylates, polyvinylpyrrolidinone.

16. The apparatus of claim 15, wherein said ionically conductive liquid includes water having an ionically conductive component added thereto, said ionically conductive component being selected from the group of atmospheric carbon dioxide ($CO_2$), lithium carbonate, sodium carbonate, potassium carbonate, sodium bicarbonate, polyhydroxyethylmethacrylate, polyacrylates, polyvinylpyrrolidinone, sodium hydroxide, gelatin, gums and mucilages both natural and synthetic.

17. The apparatus of claim 9, further including a conductive housing for supporting said wetted donor member, said electrical bias applying means being coupled directly to said conductive housing for applying the electrical bias to said wetted donor member.

18. The apparatus of claim 17, wherein said housing is fabricated from a conductive material selected from the group of brass, stainless steel and a polymer composite loaded with conductive particles.

19. The apparatus of claim 9, further including a support blade situated in abutment with said donor member for urging said donor member against the member to be charged.

20. The apparatus of claim 17, further including a sealing member for preventing escape of said ionically conductive liquid from said housing at an interface with the member to be charged.

21. The apparatus of claim 9, wherein the member to be charged includes a photoconductive imaging member.

22. The apparatus of claim 9, wherein said means for applying an electrical bias to said ionically conductive liquid includes a DC voltage power supply.

23. An electrostatographic printing apparatus including a charging device for applying an electrical charge to an imaging member, comprising:

a donor member wetted with an ionically conductive liquid, said donor member being positioned in contact with the imaging member;

a support blade for urging said donor member against the imaging member; and means for applying an electrical bias to said wetted donor member, wherein the electrical bias transports ions through said ionically conductive liquid to the imaging member for transferring ions thereto.

24. The electrostatographic printing apparatus of claim 23, wherein said donor member is fabricated from a hydrophilic material selected from the group of polyurethane foam, and polyvinylalcohol-copolyvinylformal foam.

25. The electrostatographic printing apparatus of claim 23, wherein said donor member is fabricated from a hydrophobic material selected from the group of VITON®, a copolymer of vinylidene fluoride/hexafluoropropylene, terpolymers of vinylidene fluoride/hexafluoropropylene, tetrafluoroethylene, polyethylene, polypropylene, polyethylpentane, polybutadiene and silicone elastomers.

26. The apparatus of claim 23, wherein said ionically conductive liquid is selected from the group of distilled water, deionized water, and polyhydroxyethylmethacrylate, polyacrylates, polyvinylpyrrolidinone.

27. The apparatus of claim 16, wherein said ionically conductive liquid includes water having an ionically conductive component added thereto, said ionically conductive component being selected from the group of atmospheric carbon dioxide ($CO_2$), lithium carbonate, sodium carbonate, potassium carbonate, sodium bicarbonate, polyhydroxyethylmethacrylate, polyacrylates, polyvinylpyrrolidinone, sodium hydroxide, gelatin, gums and mucilages both natural and synthetic.

28. The electrostatographic printing apparatus of claim 23, further including a conductive housing for supporting said wetted donor member, said electrical bias applying means being coupled directly to said conductive housing for applying the electrical bias to said wetted donor member.

29. The electrostatographic printing apparatus of claim 28, wherein said housing is fabricated from a conductive material selected from the group of brass, stainless steel, and a polymer composite loaded with conductive particles.

30. The apparatus of claim 23, further including a wiper blade for removing any amount of ionically conductive liquid from the imaging member.

31. The electrostatographic printing apparatus of claim 28, further including a sealing member for preventing escape of said ionically conductive liquid from said housing at an interface with the imaging member.

32. The electrostatographic printing apparatus of claim 23, wherein the imaging member includes a photoconductive imaging member.

33. The electrostatographic printing apparatus of claim 23, wherein said means for applying an electrical bias to said ionically conductive liquid includes a DC voltage power supply.

34. An electrostatographic printing apparatus including a charging device for applying an electrical charge to an imaging member, comprising:

a donor member wetted with an ionically conductive liquid, said donor member being positioned in contact with the imaging member;

a wiper blade for removing any amount of ionically conductive liquid from the imaging member; and means for applying an electrical bias to said wetted donor member, wherein the electrical bias transports ions through said ionically conductive liquid to the imaging member for transferring ions thereto.

35. The apparatus of claim 34, wherein said donor member is fabricated from a hydrophilic material selected from the group polyurethane foam, and polyvinylalchol-co-polyvinylformal foam.

36. The apparatus of claim 34, wherein said donor member is fabricated from a hydrophobic material selected from the group of VITON®, a copolymer of vinylidene fluoride/hexafluoropropylene, terpolymers of vinylidene fluoride/hexafluoropropylene, tetrafluoroethylene, polyethylene, polypropylene, polyethylpentane, polybutadiene and silicone elastomers.

37. The apparatus of claim 34, wherein said ionically conductive liquid is selected from the group of distilled water, deionized water, and polyhydroxyethylmethacrylate, polyacrylates, polyvinylpyrrolidinone.

38. The apparatus of claim 37, wherein said ionically conductive liquid includes water having an ionically conductive component added thereto, said ionically conductive component being selected from the group of atmospheric carbon dioxide ($CO_2$), lithium carbonate, sodium carbonate, potassium carbonate, sodium bicarbonate, polyhydroxyethylmethacrylate, polyacrylates, polyvinylpyrrolidinone, sodium hydroxide, gelatin, gums and mucilages both natural and synthetic.

39. The apparatus of claim 21, further including a conductive housing for supporting said wetted donor member, said electrical bias applying means being coupled directly to said conductive housing for applying the electrical bias to said wetted donor member.

40. The apparatus of claim 39, wherein said housing is fabricated from a conductive material selected from the group of brass, stainless steel and a polymer composite loaded with conductive particles.

41. The apparatus of claim 34, further including a support blade situated in abutment with said donor member for urging said donor member against the imaging member.

42. The apparatus of claim 39, further including a sealing member for preventing escape of said ionically conductive liquid from said housing at an interface with the imaging member.

43. The apparatus of claim 34, wherein the imaging member includes a photoconductive imaging member.

44. The apparatus of claim 34, wherein said means for applying an electrical bias to said ionically conductive liquid includes a DC voltage power supply.

* * * * *